US009351623B2

(12) United States Patent
Carter

(10) Patent No.: US 9,351,623 B2
(45) Date of Patent: May 31, 2016

(54) STEAM CLEANERS

(71) Applicant: TECHTRONIC FLOOR CARE TECHNOLOGIES LIMITED, Tortola (VG)

(72) Inventor: Daniel Carter, Droitwich (GB)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 14/399,218

(22) PCT Filed: May 8, 2013

(86) PCT No.: PCT/GB2013/051195

§ 371 (c)(1),
(2) Date: Nov. 6, 2014

(87) PCT Pub. No.: WO2013/167892

PCT Pub. Date: Nov. 14, 2013

(65) Prior Publication Data

US 2015/0128374 A1 May 14, 2015

(30) Foreign Application Priority Data

May 8, 2012 (GB) ..... 1208031.3

(51) Int. Cl.
*A47L 11/34* (2006.01)
*A47L 11/40* (2006.01)
*A47L 13/22* (2006.01)

(52) U.S. Cl.
CPC ..... *A47L 11/4083* (2013.01); *A47L 11/34* (2013.01); *A47L 11/4086* (2013.01); *A47L 11/4088* (2013.01); *A47L 13/225* (2013.01)

(58) Field of Classification Search
CPC ... A47L 11/34; A47L 11/408; A47L 11/4083; A47L 11/4088; A47L 13/225
USPC ..... 15/320
IPC ..... A47L 11/34
See application file for complete search history.

(56) References Cited

U.S. PATENT DOCUMENTS

2003/0233727 A1* 12/2003 Wheeler ..... A47L 5/24 15/320
2008/0189900 A1 8/2008 Milanese
2011/0232685 A1 9/2011 Paffrath et al.

FOREIGN PATENT DOCUMENTS

EP 1857035 A1 11/2007

OTHER PUBLICATIONS

International Search Report for Application No. PCT/GB2013/051195 dated Jul. 29, 2013 (6 pages).

* cited by examiner

*Primary Examiner* — David Redding
(74) *Attorney, Agent, or Firm* — Michael Best & Friedrich LLP

(57) ABSTRACT

A steam cleaner comprising a cleaning head; means for supplying steam to the cleaning head to be emitted thereby; means for supplying a cleaning agent to the cleaning head to be emitted thereby; and control means for controlling the emission of steam and cleaning agent by the cleaning head; wherein the control means is operable to cause or permit the emission of cleaning agent by the cleaning head while the emission of steam from the cleaning head is at least substantially prevented.

15 Claims, 2 Drawing Sheets

STEAM CLEANERS

BACKGROUND

This invention relates to steam cleaners.

The use of steam cleaners for cleaning floor and other surfaces is well known. For cleaning floor surfaces a steam cleaner has a cleaning head comprising a body able to be moved, by a user, over a surface to be cleaned. The body may carry, in use, a cleaning element which may be of, or include, a fabric/textile or other material of a steam permeable absorbent nature. Steam is emitted from the body and passes through the cleaning element to impinge on the surface being cleaned, with the effect of loosening dirt from the surface. Dirty water from condensation of the steam on the surface, containing the loosened dirt, is absorbed by the cleaning element.

A further provision known in such a steam cleaner is the ability to store a cleaning agent, e.g. a solution of a suitable detergent, to assist the steam cleaning operation. The present invention relates to a steam cleaner having such provision.

SUMMARY

Certain types of surfaces can readily be cleaned by a steam cleaner, e.g. tiled floors, but certain other types of surfaces, typically those which are wood-based such as some wood or wood-laminate floorings, may be vulnerable to damage by absorption of hot water from condensing steam. Therefore, the makers of such vulnerable flooring materials may not approve the use of steam cleaners.

With the object of making a steam cleaner as above described more versatile in terms of being able to clean a wider range of surfaces including some of those for which steam cleaning is not an approved cleaning method, the present invention provides a steam cleaner comprising a cleaning head; means for supplying steam to the cleaning head to be emitted thereby; means for supplying a cleaning agent to the cleaning head to be emitted thereby; and control means for controlling the emission of steam and cleaning agent by the cleaning head; wherein the control means is operable to cause or permit the emission of cleaning agent by the cleaning head, while the emission of steam from the cleaning head is at least substantially prevented.

The control means may comprise separate control members controlling the supply of steam and cleaning agent, or preferably a single control member may operate to control supply of both steam and cleaning agent together. In the latter case, an angularly-moveable control member may be moveable between positions in which supply of steam alone, cleaning agent alone or substantially alone, and steam and cleaning agent together are respectively effected.

The steam may be supplied by the controlled pumping of water from the tank thereof to a steam generator. The supply of cleaning agent may be effected from a tank thereof by a pump which may be operable at a variable speed, by a pump or by gravity. In the case of gravity supply of the cleaning agent, the control member may alter the degree of opening of a constriction in the path of flow of the cleaning agent to the cleaning head. Such constriction may be effected by a valve such as a needle valve, or by deformation of a flexible length of piping, to control occlusion thereof from fully open to completely closed.

The steam cleaner preferably is of the type wherein the cleaning head is attached to a wand having a handle by which the user is able to lift the steam cleaner and manipulate it so that the cleaning head is moved as required over a surface to be cleaned. The steam cleaner comprises a tank for water, and a steam generator to which water from the tank is supplied when steam is required to be emitted from the cleaning head. The tank and steam generator may be provided on or in association with the cleaning head, or in a body attached to or forming part of the wand and handle assembly.

BRIEF DESCRIPTION OF THE DRAWINGS

The invention will now be described by way of example by reference to the accompany drawings, of which.

DETAILED DESCRIPTION

Figure 1:
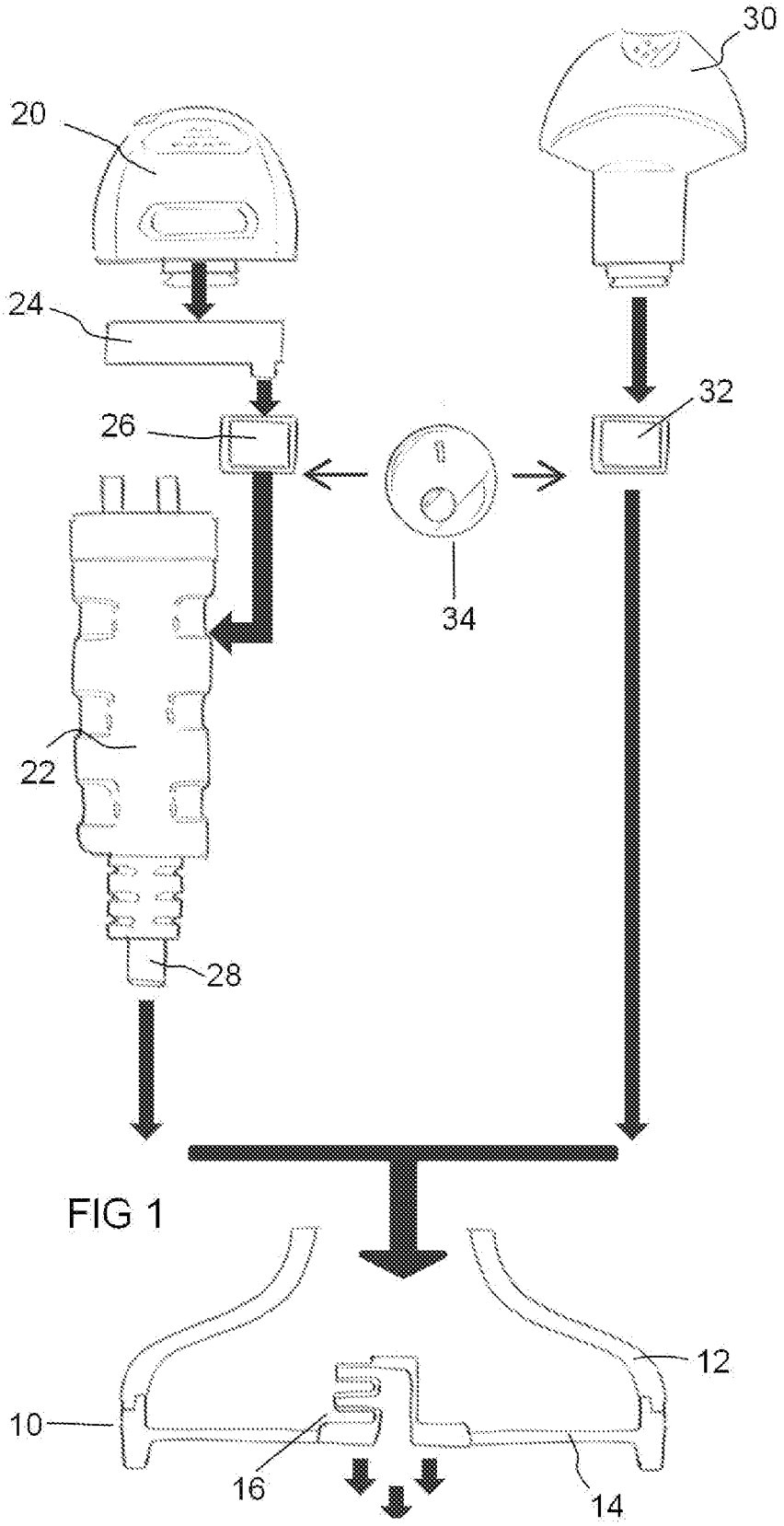
FIG. 1 diagrammatically illustrates the functional components of the steam/cleaning agent delivery system for a steam cleaner in accordance with one embodiment of the invention.

Referring firstly to FIG. 1 of the drawings, the cleaning head of a steam cleaner is indicated generally at 10. It comprises a body 12 with a base 14 which faces a surface such as a floor surface to be cleaned. A delivery assembly 16 provides for the emission of steam and/or a cleaning solution through one or more outlets facing the surface to be cleaned. For cleaning a hard surface such as a wooden or tiled floor surface, the cleaning head would carry a cleaning element e.g. of textile material through which the steam and/or cleaning agent are emitted towards the surface, the cleaning element also absorbing dirty water and/or cleaning agent containing dirt loosened from the surface being cleaned.

The cleaning head 10 is preferably provided at the lower (in use) end of a handle assembly by which the cleaner can be moved and manipulated to work the cleaning head over the surface being cleaned. The handle may also comprise a casing or casings in which are installed the components described hereafter, to deliver steam and/or the cleaning agent to the surface being cleaned, usually by way of flexible pipes since generally the cleaning head is pivotable relative to the handle assembly.

For delivering steam to the cleaning head there is a steam supply apparatus comprising firstly a tank 20 of water. There is a steam generator 22 which is electrically heated, and water is delivered from the tank to the steam generator by way of a filter 24 and pump, e.g. electrically operable, 26. A flexible pipe extending from the steam generator to the delivery assembly 16 is indicated at 28.

For delivering cleaning agent to the delivery assembly 16, there is a tank 30 for containing the cleaning agent, which may be a cleaning solution of a suitable detergent in water, and a pump 32 for supplying the cleaning solution to a flexible pipe leading to the delivery assembly 16.

The operation of both the pump 26 and pump 32 is under control of a manually operable control member, which may be a rotary member or dial as indicated at 34. One rotational position of the member 34 may provide for the pump 26 to be operated at its maximum while the pump 32 is off, while further positions may provide for both the pumps to be operated at full speed or at lesser different speeds from one another, and a further position may provide that the pump 32 is operated at its full speed while the pump 26 operates at a minimum speed or is completely switched off.

Figure 2:
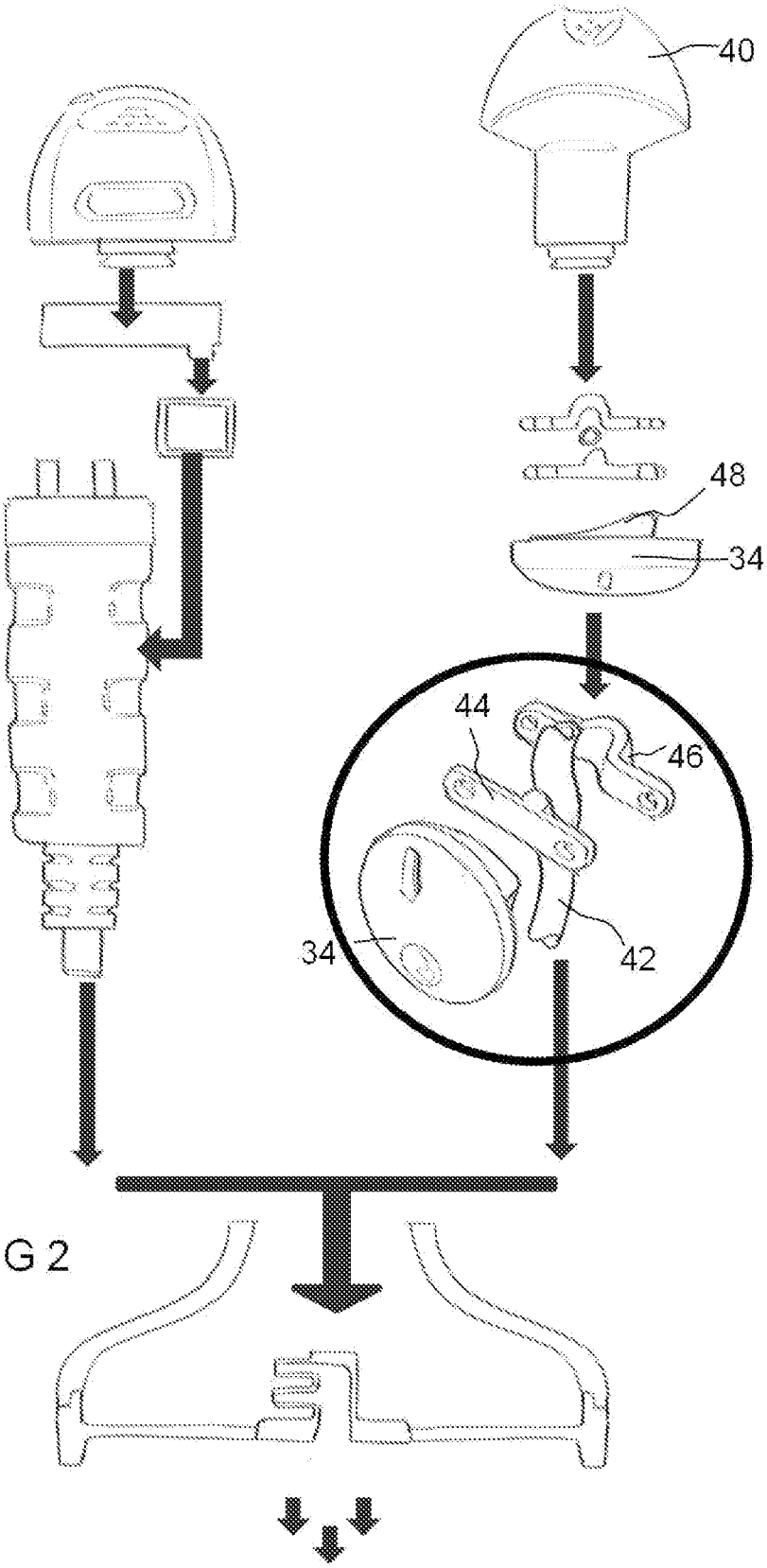
FIG. 2 is a diagrammatic view as FIG. 1 of a further embodiment of the invention.

FIG. 2 shows an arrangement which is similar to FIG. 1 in respect of the components for supplying steam to the cleaning head. In this case, however, cleaning solution from a tank 40 is supplied under gravity to the delivery assembly of the cleaning head, by way of a flexible tube 42. Instead of the control member 34 controlling the on or off condition, and speed, of pump 32, it is arranged (as shown in the inset to FIG. 2) mechanically to deform the tube 42 between two members 44, 46, the tube being squeezed between the members 44, 46 by way of a cam surface 48 provided on the member 34. By this means, the delivery of cleaning agent from the tank 40 is controlled from zero to a maximum, the control member operating to control the on/off state and speed of the pump 26 as described in relation to FIG. 1 to provide the combination of different steam and cleaning agent delivery proportions.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A steam cleaner comprising a cleaning head; means for supplying steam to the cleaning head to be emitted thereby; means for supplying a cleaning agent to the cleaning head to be emitted thereby; and control means for controlling the emission of steam and cleaning agent by the cleaning head; wherein the control means is operable to cause or permit the emission of cleaning agent by the cleaning head while the emission of steam from the cleaning head is at least substantially prevented, wherein the control means includes a single control member operable to control the supply of both steam and cleaning agent, wherein the cleaning agent is supplied from a cleaning agent tank thereof under gravity.

2. A steam cleaner according to claim 1 wherein the control member is moveable between positions in which supply of steam alone, cleaning agent alone, or substantially alone, and steam and cleaning agent together are respectively effected.

3. A steam cleaner according to claim 2 wherein the control member is moveable angularly between said positions.

4. A steam cleaning according to claim 1 wherein steam is supplied by a water pump operable to pump water from a water tank thereof to a steam generator, the control means controlling the speed of the water pump.

5. A steam cleaning according to claim 4 wherein the cleaning agent is supplied by cleaning agent pump operable to pump cleaning agent from a cleaning agent tank, the control means being operable to control the speed of the cleaning agent pump.

6. A steam cleaner according to claim 1 wherein the control means effects alteration of the degree of opening of a constriction in the path of flow of the cleaning agent from the cleaning agent tank thereof to the cleaning head.

7. A steam cleaner according to claim 6 wherein the constriction comprises a valve.

8. A steam cleaner according to claim 6 wherein the constriction comprises a controllably-deformable flexible pipe portion.

9. A steam cleaning according to claim 1 wherein the cleaning agent is supplied by a cleaning agent pump operable to pump cleaning agent from a cleaning agent tank, the control means being operable to control the speed of the cleaning agent pump.

10. A steam cleaner comprising:

a cleaning head;

a steam generator operable to produce a quantity of steam and to selectively deliver steam to the cleaning head;

a cleaning agent supply including a supply of cleaning agent and to selectively deliver cleaning agent to the cleaning head;

a control member movable between a first position in which only one of steam and cleaning agent is delivered to the cleaning head, a second position in which only the other of steam and cleaning agent is delivered to the cleaning head, and a third position in which both steam and cleaning agent is delivered to the cleaning head;

a first pump operable to deliver the steam to the cleaning head; and a second pump operable to deliver the cleaning agent to the cleaning head, wherein the control member is movable to adjust a speed of the first pump between zero and a maximum speed and to adjust a speed of the second pump between zero and a maximum speed.

11. The steam cleaner of claim 10, wherein the control member is movable to a fourth position in which neither steam nor cleaning agent is delivered to the cleaning head.

12. The steam cleaner of claim 10, wherein the control member includes a single rotatable dial.

13. A steam cleaner comprising:

a cleaning head;

a first tank containing a quantity of water;

a steam generator operable to produce a quantity of steam and to deliver steam to the cleaning head;

a first pump operable at a first speed between zero and a maximum speed to deliver a variable quantity of water to the steam generator;

a second tank separate from the first tank and operable to contain a quantity of cleaning agent;

a second pump operable at a second speed between zero and a maximum speed to deliver a variable quantity of cleaning agent to the cleaning head; and a single control member movable to select the first operating speed for the first pump and the second operating speed for the second pump.

14. The steam cleaner of claim 13, wherein the single control member is movable between a first position in which only one of steam and cleaning agent is delivered to the cleaning head, a second position in which only the other of steam and cleaning agent is delivered to the cleaning head, a third position in which both steam and cleaning agent is delivered to the cleaning head, and a fourth position in which neither steam nor cleaning agent is delivered to the cleaning head.

15. The steam cleaner of claim 13, wherein the control member includes a single rotatable dial.

* * * * *